US005808430A

United States Patent [19]

Ho

[11] Patent Number: 5,808,430

[45] Date of Patent: Sep. 15, 1998

[54] ELECTRICALLY CONTROLLED CURTAINS

[76] Inventor: Wai Chau Ho, Flat C,D & K, 2 Fl., Block 3, Golden Dragon Industrial Centre 172-180 Tai Lin Pai Road, Kwai Chung, NT Kowloo, Hong Kong

[21] Appl. No.: 935,792

[22] Filed: Sep. 23, 1997

Related U.S. Application Data

[63] Continuation of Ser. No. 650,550, May 20, 1996, abandoned, which is a continuation of Ser. No. 273,814, Jul. 12, 1994, abandoned.

[30] Foreign Application Priority Data

Jul. 13, 1993 [GB] United Kingdom ..... 9314408

[51] Int. Cl.[6] ..... H02P 1/40

[52] U.S. Cl. ..... 318/266; 318/286; 318/468; 49/357; 160/5; 160/DIG. 17

[58] Field of Search ..... 318/286, 480, 318/256, 280, 434, 266, 469, 293, 468, 282; 49/357, 25, 324; 160/331, 5, 310, 311, DIG. 17

[56] References Cited

U.S. PATENT DOCUMENTS

| | | | |
|---|---|---|---|
| 4,131,831 | 12/1978 | Bochenek et al. . | |
| 4,437,506 | 3/1984 | Ogita . | |
| 4,618,804 | 10/1986 | Iwasaki | 318/480 |
| 4,712,104 | 12/1987 | Kobayashi | 49/357 |
| 4,827,199 | 5/1989 | Kavcic et al. | 160/331 |
| 5,170,108 | 12/1992 | Peterson et al. | 318/286 |

FOREIGN PATENT DOCUMENTS

| | | |
|---|---|---|
| 1555337 | 11/1979 | United Kingdom . |
| 2228587 | 8/1990 | United Kingdom . |

*Primary Examiner*—John W. Cabeca
*Attorney, Agent, or Firm*—Young & Thompson

[57] ABSTRACT

An electrical control arrangement for a curtain assembly has a reversible electric, preferably DC, drive motor, drive devices for connecting the motor to one or more curtains for movement of the curtains in opening and closing directions in response to rotation of the motor in respective opposite directions, and a control device for the motor. The control device includes first, user-operable, preferably remotely-operable, switch device for selecting opening and closing directions of curtain movement, and second switch device positionable for operation by a curtain upon reaching a limit position of its movement in an opening and/or a closing direction. The first and second switch devices are arranged such that the first switch device, when actuated to move the curtain(s) in a first direction, causes energization of the motor to cause it to rotate in a first direction until actuation of the second switch at the limit position, whereupon the second switch device de-energizes the motor and adopts a condition to cause rotation of the motor in the opposite direction when the first switch device is next actuated for movement of the curtain(s) in the second, opposite direction.

11 Claims, 2 Drawing Sheets

ELECTRICALLY CONTROLLED CURTAINS

This application is a continuation of application Ser. No. 08/650,550, filed May 20, 1996, which is a continuation of Ser. No. 08/273,814, filed Jul. 12, 1994, both now abandoned.

FIELD OF THE INVENTION

This invention relates to electrically controlled curtains and has for its object to improve on previously-known electrically operated curtain arrangements.

SUMMARY OF THE INVENTION

The present invention provides an electrical control arrangement for a curtain assembly, comprising, a reversible electric drive motor, drive means for connecting the motor to one or more curtains for movement of the curtains in opening and closing directions in response to rotation of the motor in respective opposite directions, and control means for the motor, the control means comprising:

first, user-operable switch means for selecting opening and closing directions of curtain movement, and second switch means positionable for operation by a curtain upon reaching a limit position of its movement in an opening and/or a closing direction, the first and second switch means being arranged such that the first switch means, when actuated to move the curtains in a first direction, causes energisation of the motor to cause it to rotate in a first direction until actuation of the second switch at the limit position, whereupon the second switch means de-energises the motor and adopts a condition to cause rotation of the motor in the opposite direction when the first switch means is next actuated for movement of the curtains in the second, opposite direction.

The motor is preferably a DC motor and, in such a case, the control means may include transformer and rectifier means for operation by AC mains power, the first and second switch means operating on the rectified DC output of the transformer and rectifier means.

Advantageously, the first switch means is remotely-operable, for example by a remote control device, producing an infra-red signal, or a signal of other electromagnetic radiation, for example of a radio frequency. To achieve this, the first switch means can incorporate a relay which is operable in response to reception by a receiver of a signal from a transmitter, conveniently a hand-held device.

In one arrangement, the receiver is powered by the AC mains and operates the relay by way of transformer and rectifier means.

The second switch means is conveniently a microswitch which is actuated by the curtain at the or each limit position.

The electrical control means of the invention can be used with any suitable curtain assembly, pre-existing or otherwise. The curtain assembly will typically include a plurality of runners movable along a guideway.

If desired, the curtain runners may form two groups which move in respective opposite directions during opening and closing of the curtains. Such an arrangement allows a pair of curtains to move together and apart during opening and closing, respectively.

Three or more curtains can be similarly operated.

The drive means conveniently comprises an endless drive member which is driven by the drive motor and is attached to the curtain(s) in the complete curtain assembly.

Embodiments of the invention will now be described by way of example with reference to the drawing of the specification, in which:

DESCRIPTION OF THE DRAWINGS

Figure 1:
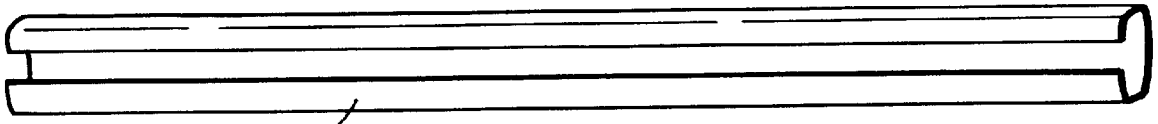
FIG. 1 shows a curtain track.
Figure 2:
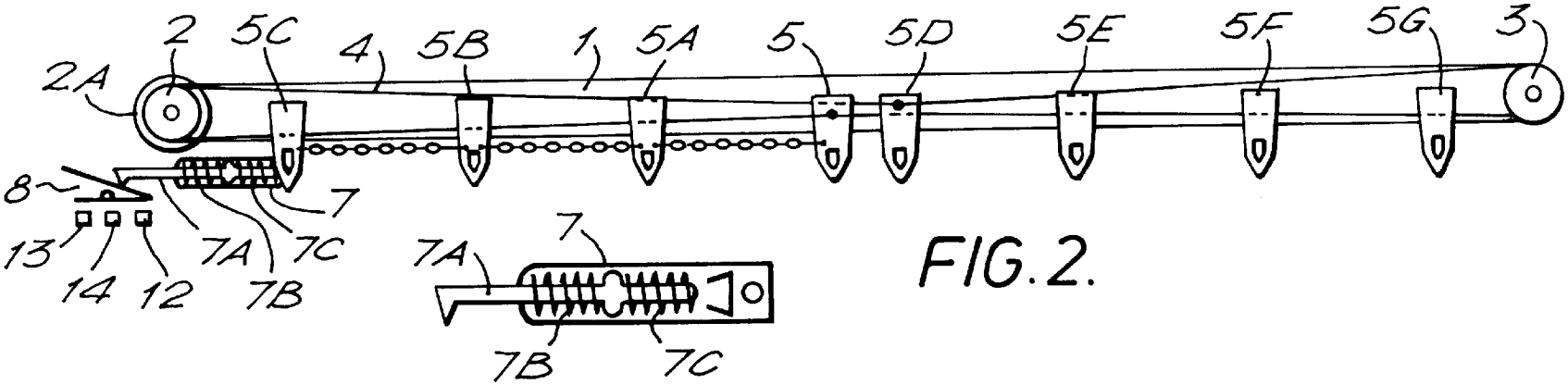
FIG. 2 shows schematically curtain runners and drive wheels attached to the track of FIG. 1, a contact device also being shown.

Referring first to FIG. 1, this shows a length of conventional curtain track 1. FIG. 2 shows the track 1, together with first and second pulleys 2, 3 rotatably mounted at respective ends of the track. The first pulley 2 is attached to a drive sprocket 2A which is driven by a DC electric motor (see below) through a gearbox, not shown. An endless drive belt 4 passes around the pulleys 2, 3. Curtain runners 5, 5A, 5B, 5C, 5D, 5E, 5F, 5G are slidable on the track 1. Eight runners are shown but there would normally be more in practice. The left-hand group of four runners 5, 5A, 5B, 5C are attached to the left-hand one of a pair of curtains (not shown). The right-hand group of runners 5D, 5E, 5F, 5G are attached to the right-hand curtain.

Short lengths of chain 6 connect the runners 5 . . . 5C. These may be omitted (see runners 5D . . . 5G) since the runners are also linked by the curtains.

The runners 5, 5D are attached respectively to the lower and upper runs of the drive belt 4, so that, upon rotation of the drive pulley 2 in the clockwise direction, the curtains open and, in response to counterclockwise rotation, the curtains close.

The left-hand runner 5C of the left-hand set of runners has attached to it a contact device 7 which includes a hook part 7A which is biased in opposite directions by respective coil springs 7B, 7C. As shown schematically in FIG. 2 the hook part 7A is arranged to contact a single pole, double throw microswitch 8 having three contacts 12, 13, 14.

Figure 3:
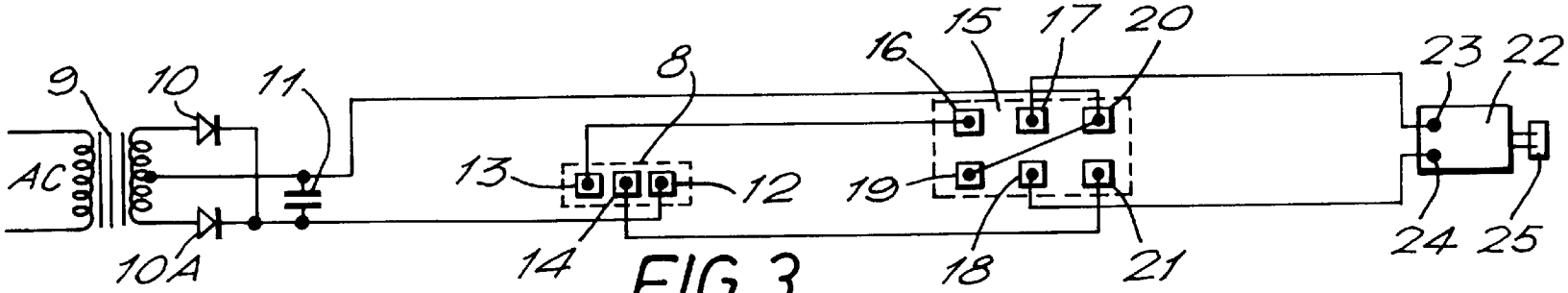
FIG. 3 is a circuit diagram of a first control circuit.

The control circuit shown in FIG. 3 is connected to the AC mains through the primary winding of a step-down transformer 9. The secondary winding of the transformer 9 is centrally tapped and also connected through rectifying diodes 10, 10A and a smoothing capacitor 11 to the remainder of the control circuit which thus operates on a low voltage DC produced by the transforming/rectifying stage 9, 10, 10A, 11. The remainder of the control circuit comprises the microswitch 8, the three contacts 12, 13, 14 of which are connected as shown in FIG. 3 to the transforming/rectifying stage 9, 10, 10A, 11 and to a sliding switch 15. The microswitch 8 is operated by the contact device 7 and is switchable between a first condition in which contacts 12 and 13 are connected and a second condition in which contacts 12 and 14 are connected.

The sliding switch 15 has six contacts 16, 17, 18, 19, 20, 21. The contact 16 is connected to the contact 13 of the microswitch. The contacts 17 and 18 are connected to respective terminals 23, 24 of a reversible DC motor 22 having an output sprocket 25 which drives the sprocket 2A (shown in FIG. 2) through the gearbox referred to above. The contacts 19 and 20 of the switch 15 are interconnected. The contact 21 is connected to the contact 14 of the microswitch 8. A sliding switch member of the switch 15 is movable between a first position, in which the contacts 17, 18 are joined to the contacts 16, 19 respectively and a second position in which the contacts 17, 18 are connected to the contacts 20, 21 respectively.

Figure 4:
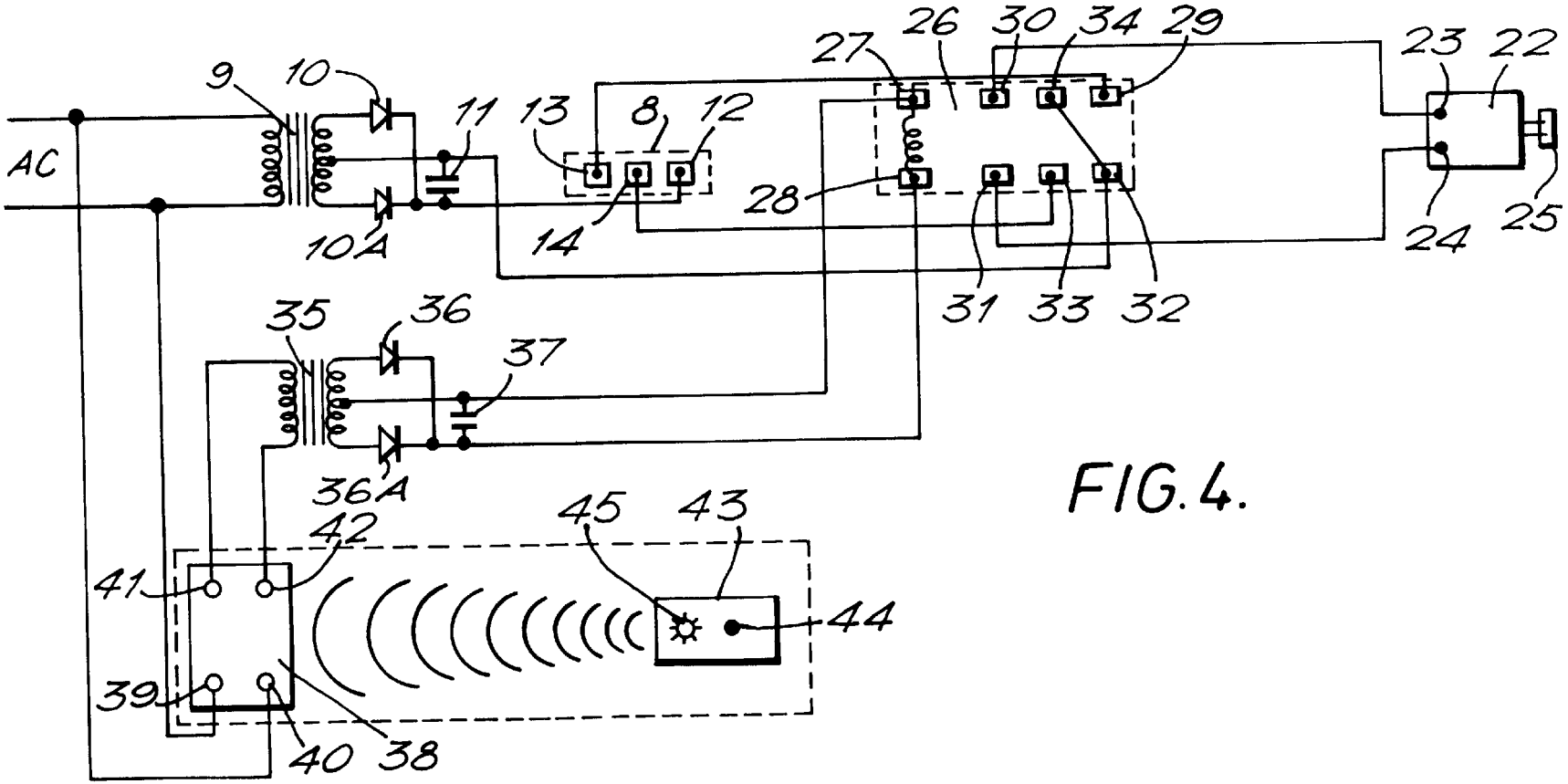
FIG. 4 is a circuit diagram of a second control circuit.

The control circuit shown in FIG. 4 includes a transforming/rectifying stage 9, 10, 10A, 11 and a microswitch 8 which correspond exactly to the equivalent parts of the control circuit of FIG. 3. The switch 26 of the second control circuit is operated by a relay and has six contacts 29, 30, 31, 32, 33, 34. The contact 29 is connected to the contact 13 of the microswitch 8. The contacts 30, 31 are connected to the terminals 23, 24 of the reversible DC motor 22. The contact 32 is connected to one output of the transforming/rectifying stage 9, 10, 10A, 11. The contact 33 is connected to the contact 14 of the microswitch 8. Also, contacts 32 and 34 are interconnected internally of the switch 26.

The relay of the switch 26 has terminals 27, 28 which are connected to the output of a further transforming/rectifying stage consisting of a step-down transformer 35, rectifying diodes 36, 36A and a smoothing capacitor 37. The transformer 35 receives its input from output terminals 41, 42 of an infra-red receiver 38 which has input terminals 39, 40 which are connected to the AC mains. The infra-red receiver 38 receives a signal from a hand-held infra-red transmitter 43 which has an operating button 44 and a tell-tale light 45. In a modification, the infra-red transmitter and receiver 43, 38 are replaced by radio frequency devices, or devices using some other frequency of electromagnetic radiation.

Operation of an electrically powered curtain assembly having a control circuit as shown in FIG. 3 will now be described.

It is assumed initially that the curtains are closed with the runners 5 . . . 5G in the positions shown schematically in FIG. 2. To open the curtains, the switch 15 is slid into its first position in which the contacts 17, 18 are connected to its contacts 16, 19, respectively. The microswitch 8 is in its first condition in which the contacts 12 and 13 are interconnected. Direct current can now flow from the output of the rectifiers 10, 10A through the microswitch 8, through contacts 16, 17 of the sliding switch 15, to the terminal 23 of the motor, returning from the motor terminal 24 through the contacts 18, 19, 20 of the sliding switch 15 to the centre tap of the transformer 9. The motor 22 is thus energised to rotate in a first, clockwise direction. As a result, the first set 5 . . . 5C of curtain runners move to the left and the second set 5D . . . 5G of runners move to the right. The curtains thus open. Opening movement continues until the hook part 7A of the contact devices 7 contacts the microswitch 8 and causes it to change from its first to its second condition, the connection between the switch contacts 12, 13 being broken and the switch contacts 12, 14 becoming connected. The DC motor will now stop because no current flow through the sliding switch 15 is possible. The curtains are now open.

When it is desired to close the curtains, the sliding switch 15 is moved to its second position in which the contact 17 is connected to the contact 20 and the contacts 18, 21 are connected to each other. In this condition, current will flow in the opposite direction through the DC motor 22, in order to produce a closing movement of the curtains. Closing will continue until the curtains are nearly closed and the runner 5C moves to the right and hook part 7A allows the microswitch 8 to revert to its first condition in which the contacts 12, 13 are connected. In this condition, the motor 20 is de-energised and movement of the curtains stops. The microswitch 85 is now in its original condition, ready for a further opening of the movement of the curtains upon movement of the sliding switch 15 into its first position.

The control circuit shown in FIG. 4 operates in an exactly similar manner to that of FIG. 3, with the exception that the infra-red remote controller 43 is used to actuate the relay switch 26 and move the contact member of the switch between its first and second positions. Thus, in the first condition of the relay 26, the contact 30 is connected to the contact 29 and the contact 31 is connected to the contact 32. In this condition, the DC from the transforming/rectifying stage 9, 10, 10A, 11 will flow through the motor 22 to cause clockwise rotation thereof.

When the user operates the control button 44 of the infra-red transmitter 43, an infra-red signal is sent to the receiver 38 and the output from the receiver will operate the relay 26 so that the contact 30 disengages the contact 29 and engages the contact 34 and the contact 31 disengages the contact 32 and engages the contact 33. In this condition, the DC will flow in the opposite direction through the motor 22 and cause counterclockwise rotation thereof. The microswitch 8 functions exactly as described with reference to FIG. 3 to prevent further rotation of the motor 22 when the curtains have reached either limit position and to ready the motor to rotate in the opposite direction when the relay 26 is reactuated to move the curtains in the opposite direction.

I claim:

1. An electrical control arrangement for a curtain assembly, comprising:

a reversible D.C. electric drive motor;

drive means for connecting the reversible electric drive motor to at least one curtain by means of a plurality of curtain runners movable along a guideway for movement of each curtain in opening and closing directions in response to rotation of the reversible electric drive motor, said drive means comprising an endless drive member driven by said reversible electric drive motor;

control means for the reversible electric drive motor, the control means comprising:

user-operable first switch means for selecting opening and closing directions of the at least one curtain; and second switch means positionable for operation by the at least one curtain upon reaching at least one predetermined position in one of an opening and a closing direction;

the first and second switch means being arranged such that the first switch means, when actuated to move the at least one curtain in a first direction, energizes the reversible electric drive motor to rotate in a first direction until actuation of the second switch means at the at least one predetermined position, whereupon the second switch means deenergizes the reversible electric drive motor and automatically adopts a condition to cause rotation of the reversible electric drive motor in an opposite direction when the first switch means is next actuated for movement of the at least one curtain in the opposite direction;

wherein the second switch means is a microswitch which is actuable by the at least one curtain at each predetermined position;

wherein the microswitch consists of three contacts, and wherein said microswitch is switchable between a first condition in which one pair of said contacts is connected and a second condition in which a second pair of said contacts is connected, the first and second conditions corresponding to opening and closing of the at least one curtain, said microswitch being actuable by a spring biased contact device including a pair of coil springs biased in opposite directions, said contact device being attached to one of said plurality of curtain runners.

2. An electrical control arrangement according to claim 1, wherein the control means includes transformer and rectifier means for operation by AC main power, the first and second switch means operating on the rectified DC output of the transformer and rectifier means.

3. An electrical control arrangement according to claim 1, wherein the first switch means comprises a sliding switch having contacts and a switch member which is movable between a first position in which one arrangement of contacts is made and a second position in which another arrangement of contacts is made, corresponding to opening and closing of the curtains.

4. An electrical control arrangement for a curtain assembly, comprising:

a reversible D.C. electric drive motor;

drive means for connecting the reversible electric drive motor to at least one curtain by means of an assembly comprising a plurality of curtain runners movable along a guideway, for movement of each curtain in opening and closing directions in response to rotation of the reversible electric drive motor, said drive means comprising an endless drive member driven by said reversible electric drive motor;

control means for the reversible electric drive motor, the control means comprising:

remotely-operable first switch means for selecting opening and closing directions of the at least one curtain; second switch means positionable for operation by the at least one curtain upon reaching at least one predetermined position in one of an opening and a closing direction;

the first and second switch means being arranged such that the first switch means, when actuated to move the at least one curtain in a first direction, energizes the reversible electric drive motor to rotate in a first direction until actuation of the second switch means at the at least one predetermined position, whereupon the second switch means deenergizes the reversible electric drive motor and automatically adopts a condition to cause rotation of the motor in an opposite direction when the first switch means is next actuated for movement of the at least one curtain in the opposite direction;

wherein the second switch means is a microswitch which is actuable by the at least one curtain at each predetermined position;

wherein the microswitch consists of three contacts, and wherein said microswitch is switchable between a first condition in which one pair of said contacts is connected and a second condition in which a second pair of said contacts is connected, the first and second conditions corresponding to opening and closing of the at least one curtain, said microswitch being actuable by a spring biased contact device including a pair of coil springs biased in opposite directions, said contact device being attached to one of said plurality of curtain runners.

5. An electrical control arrangement according to claim 4, wherein the first switch means is remotely operable by a remote control device employing a signal of electromagnetic radiation.

6. An electrical control arrangement according to claim 5, wherein the remote control device employs an infra-red signal or a radio frequency signal.

7. An electrical control arrangement according to claim 5, wherein the first switch means incorporates a relay which is operable in response to reception by a receiver of a signal from a transmitter.

8. An electrical control arrangement according to claim 7, wherein the transmitter is a hand-held device.

9. An electrical control arrangement according to claim 7, wherein the receiver is powered by AC mains and operates the relay by way of transformer and rectifier means.

10. A combination according to claim 4, wherein the curtain runners form a plurality of groups, each group associated with a respective curtain, which can move in respective preselected directions during opening and closing of the curtains.

11. An electrical control arrangement according to claim 4, wherein the first switch means comprises a sliding switch having contacts and a switch member which is movable between a first position in which one arrangement of contacts is made and a second position in which another arrangement of contacts is made, corresponding to opening and closing of the curtains.

* * * * *

UNITED STATES PATENT AND TRADEMARK OFFICE

CERTIFICATE OF CORRECTION

PATENT NO. : 5,808,430

DATED : September 15, 1998

INVENTOR(S) : Wai Chau HO

It is certified that error appears in the above-indentified patent and that said Letters Patent is hereby corrected as shown below:

On the title page, insert in item [56], following the citation of United Kingdom patent 2228587, the following additional United Kingdom reference:

--2241158 8/1991 United Kingdom--.

Signed and Sealed this

Nineteenth Day of January, 1999

*Attest:*

*Attesting Officer*

*Acting Commissioner of Patents and Trademarks*